US009502818B2

(12) United States Patent
Zhang

(10) Patent No.: US 9,502,818 B2
(45) Date of Patent: Nov. 22, 2016

(54) USB PLUG WITHOUT A METALLIC SHELL

(71) Applicant: DONGGUAN XUNTAO ELECTRONIC CO., LTD., Dongguan, Guangdong Province (CN)

(72) Inventor: Wen-Chuan Zhang, Dougguan (CN)

(73) Assignee: DONGGUAN XUNTAO ELECTRONIC CO., LTD., Dongguan, Guangdong Province (CN)

( * ) Notice: Subject to any disclaimer, the term of this patent is extended or adjusted under 35 U.S.C. 154(b) by 0 days.

(21) Appl. No.: 14/583,737

(22) Filed: Dec. 28, 2014

(65) Prior Publication Data

US 2016/0134051 A1 May 12, 2016

(30) Foreign Application Priority Data

Nov. 11, 2014 (CN) ..... 2014 2 0675229 U

(51) Int. Cl.

| | |
|---|---|
| ***H01R 13/62*** | (2006.01) |
| ***H01R 13/504*** | (2006.01) |
| ***H01R 24/60*** | (2011.01) |
| *H01R 13/405* | (2006.01) |
| *H01R 107/00* | (2006.01) |

(52) U.S. Cl.

CPC ..... *H01R 13/6205* (2013.01); *H01R 13/504* (2013.01); *H01R 24/60* (2013.01); *H01R 13/405* (2013.01); *H01R 2107/00* (2013.01)

(58) Field of Classification Search

USPC ..... 439/39, 38, 638, 218

See application file for complete search history.

(56) References Cited

U.S. PATENT DOCUMENTS

| | | | | |
|---|---|---|---|---|
| 7,445,452 | B1 * | 11/2008 | Wu | 439/39 |
| 7,963,773 | B2 * | 6/2011 | Palli et al. | 439/38 |
| 8,152,533 | B1 * | 4/2012 | Lin | 439/39 |
| 8,678,853 | B2 * | 3/2014 | Tai et al. | 439/404 |
| 8,770,986 | B2 * | 7/2014 | Furness et al. | 439/39 |
| 8,944,826 | B1 * | 2/2015 | Wilkolaski et al. | 439/39 |
| 9,048,570 | B2 * | 6/2015 | Goel | |
| 2010/0015831 | A1 * | 1/2010 | Miyoshi | 439/218 |
| 2013/0078858 | A1 * | 3/2013 | Wu et al. | 439/607.41 |
| 2013/0115821 | A1 * | 5/2013 | Golko et al. | 439/638 |

FOREIGN PATENT DOCUMENTS

| | | |
|---|---|---|
| CN | 202888483 U | 4/2013 |
| CN | 203300859 U | 11/2013 |

* cited by examiner

*Primary Examiner* — Alexander Gilman

(74) *Attorney, Agent, or Firm* — Cheng-Ju Chiang

(57) ABSTRACT

A USB plug includes a first housing piece having a base portion and a tongue portion extending forwards from the base portion, a second housing piece, a plurality of contacts and a cable. Each contact comprises a contacting portion, a retaining portion fixed in the first housing piece and a tail portion, the contacting portions exposed on the tongue portion for mating with a USB receptacle connector. The cable is soldering with tail portions of the contacts. The first housing piece defines a depression on a bottom surface thereof, the second housing piece is received in the depression and ultrasonic welding with the first housing piece.

13 Claims, 5 Drawing Sheets

USB PLUG WITHOUT A METALLIC SHELL

BACKGROUND OF THE INVENTION

1. Field of the Invention

The present invention relates to a USB plug, and more particularly to a USB plug without a metallic shell.

2. Description of Related Art

Universal Serial Bus (USB) is a serial bus standard to the PC architecture with a focus on computer telephony interface, consumer and productivity applications. Peripherals with a USB interface are able to support hot plug and play. A USB plug comprises an insulative housing, a plurality of contacts and a metallic shell, the metallic shell is enclosing on a tongue portion of the insulative housing to form a cavity, the contacts are arranged on the tongue portion and exposed in the cavity for mating with a complementary USB receptacle. However the USB plug has a larger thickness, and can't satisfy the requirement of miniaturization and lightweight.

Hence, a USB plug with improved configuration is desired to overcome the above problems.

BRIEF SUMMARY OF THE INVENTION

The present invention provides a USB plug including a first housing piece having a base portion and a tongue portion extending forwards from the base portion, a second housing piece, a plurality of contacts and a cable. Each contact comprises a contacting portion, a retaining portion fixed in the first housing piece and a tail portion, the contacting portions exposed on the tongue portion for mating with a USB receptacle connector. The cable is soldering with tail portions of the contacts. The first housing piece defines a depression on a bottom surface thereof, the second housing piece is received in the depression and ultrasonic welding with the first housing piece.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENT

Figure 1:
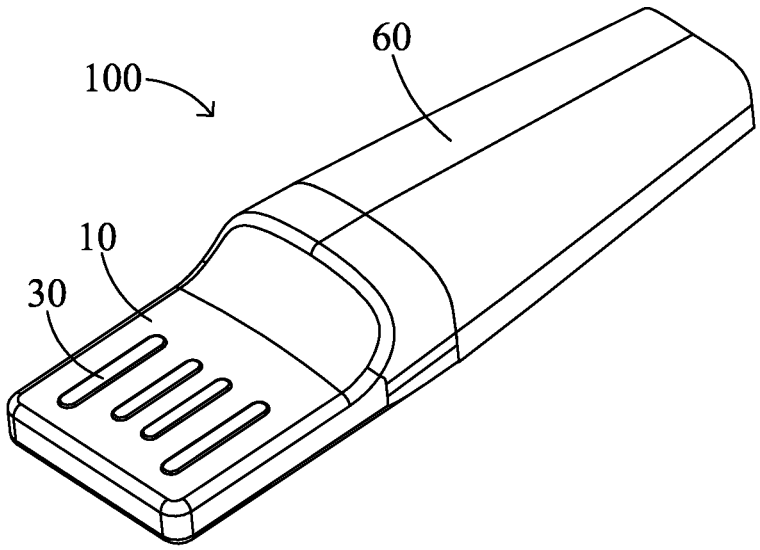
FIG. 1 is a perspective view of a USB plug in accordance with the present invention.

Reference will now be made to the drawing figures to describe the embodiments of the present invention in detail. In the following description, the same drawing reference numerals are used for the same elements in different drawings.

Figure 2:
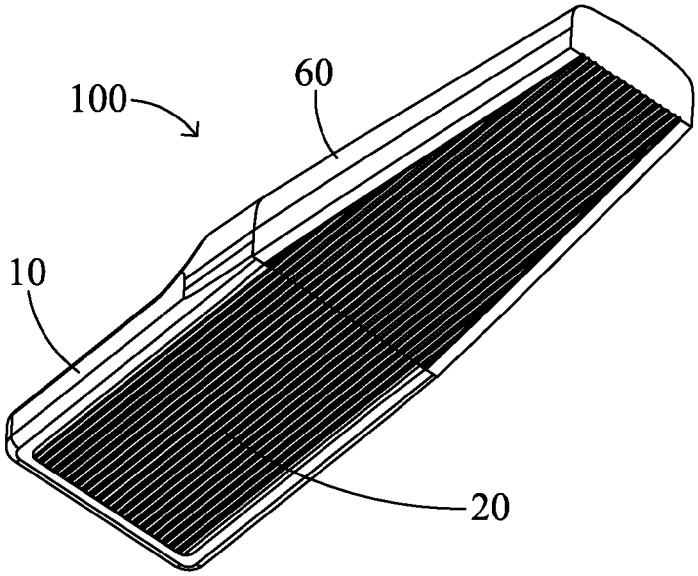
FIG. 2 is a view similar to FIG. 1, but viewed from a different aspect.
Figure 3:
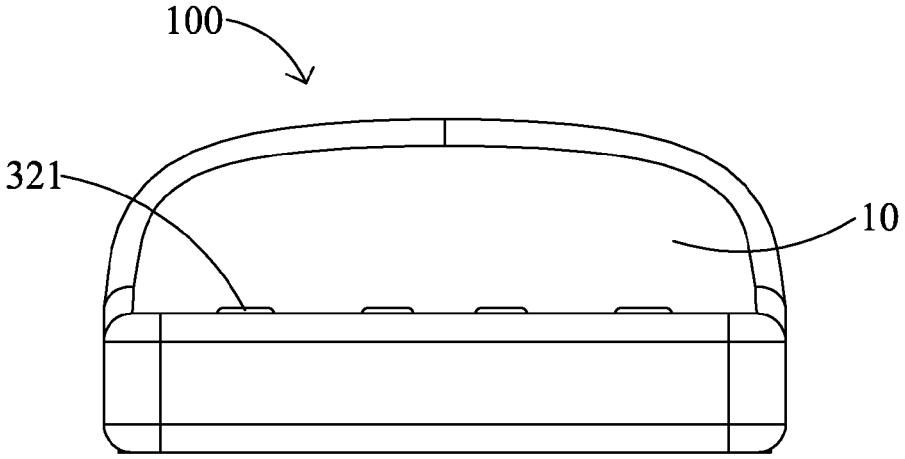
FIG. 3 is a front view of the USB plug shown in FIG. 1.
Figure 4:
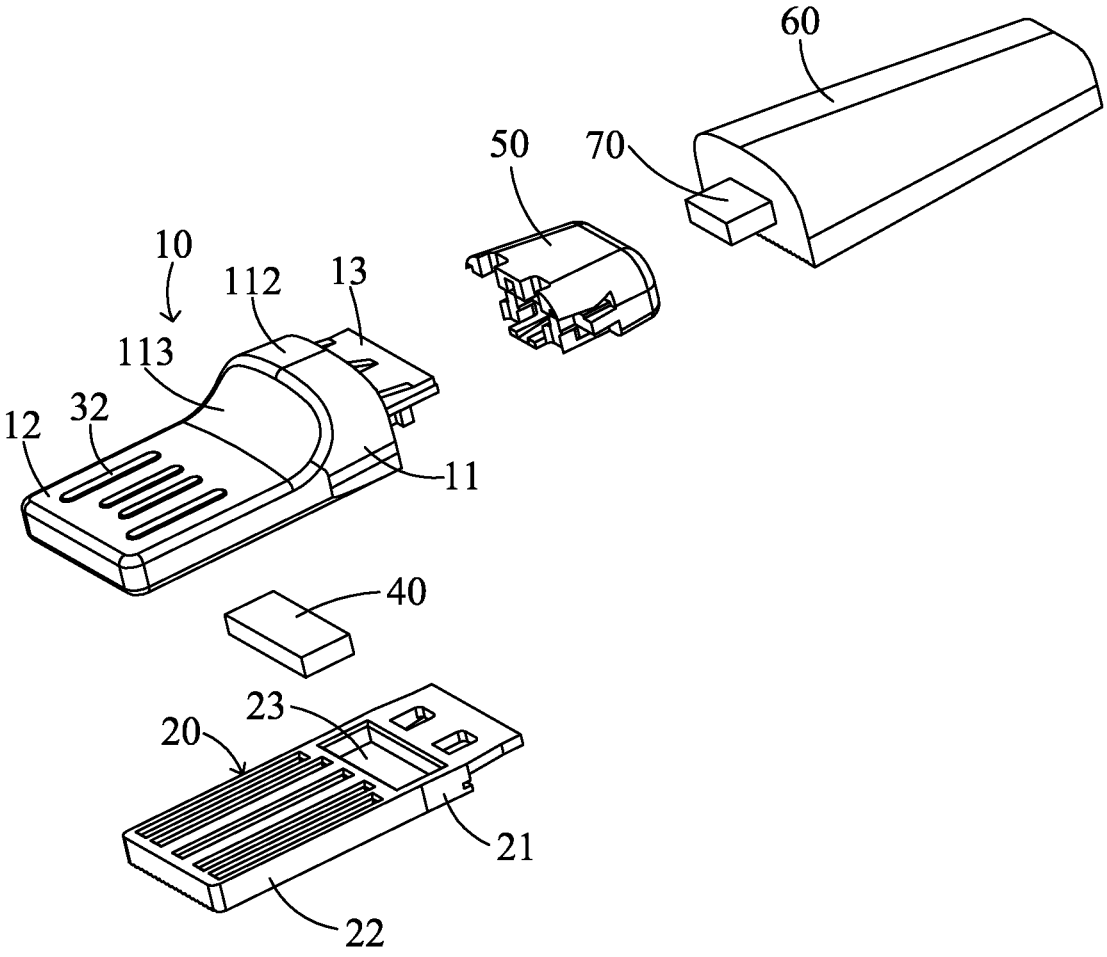
FIG. 4 is an exploded, perspective view of the USB plug shown in FIG. 1.
Figure 5:
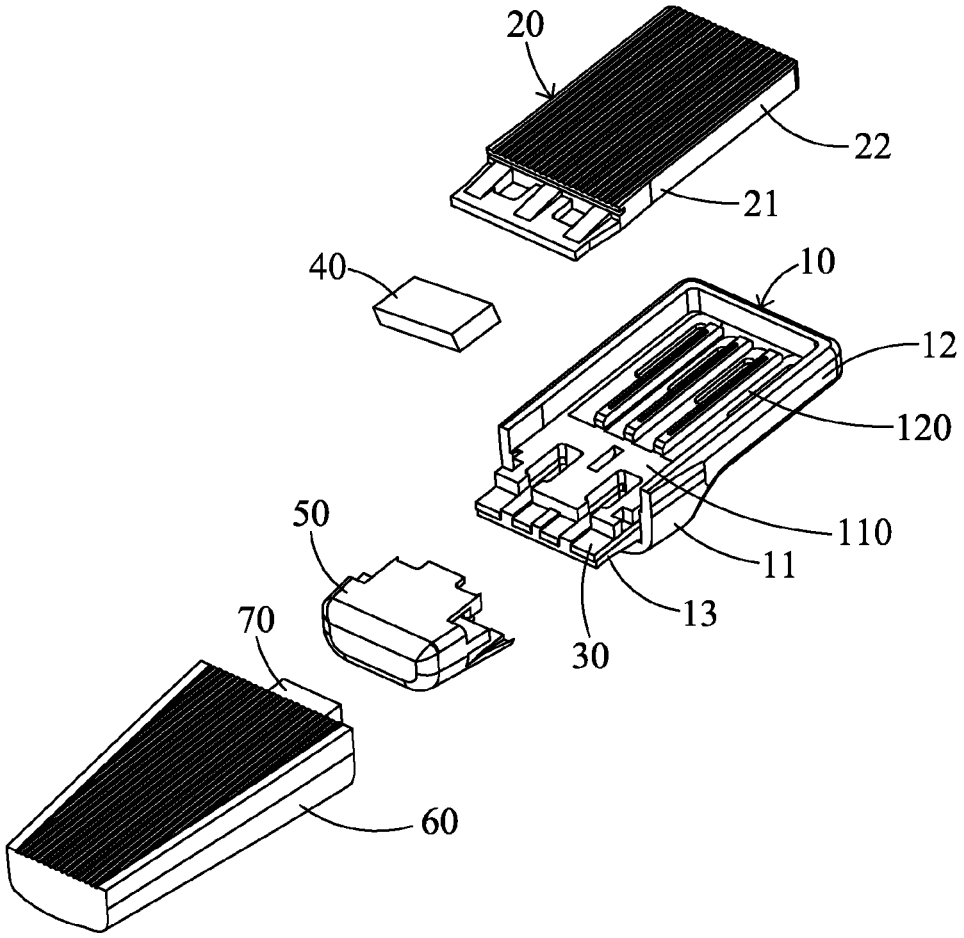
FIG. 5 is a view similar to FIG. 4, but viewed from a different aspect.
Figure 6:
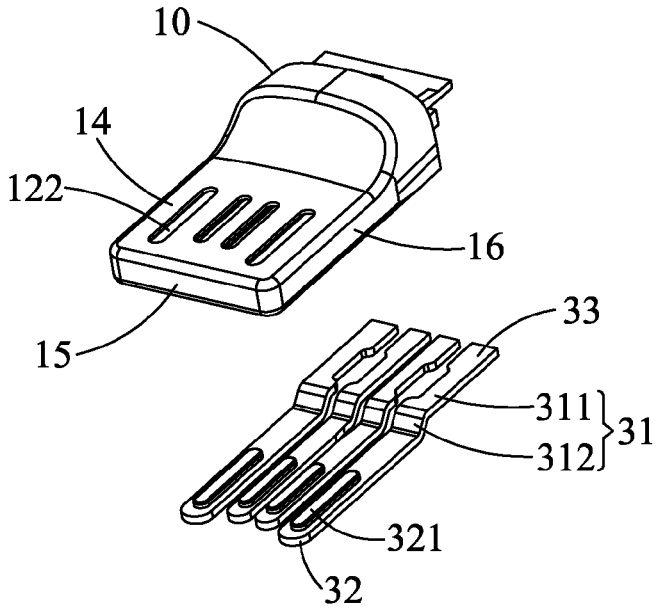
FIG. 6 is a perspective view of contacts separated from a first housing piece shown in FIG. 4.
Figure 7:
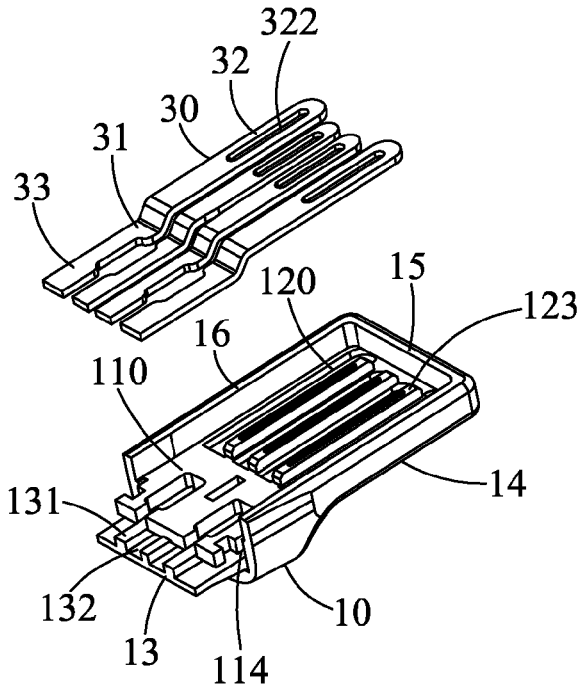
FIG. 7 is a view similar to FIG. 6, but viewed from a different aspect.

Referring to FIGS. 1 to 7, the present invention discloses a USB plug 100 being capable of mating with a USB receptacle connector (not shown), and the USB plug 100 includes a first housing piece 10, a second housing piece 20, a plurality of contacts 30, a magnet 40, an inner insulator 50, an exterior insulator 60 and a cable 70. The first and second housing piece 10, 20, the inner insulator 50 are made of plastic material, the exterior insulator 60 is made of silicone, thus the USB plug is configured to be soft and flexible with a comfortable feel.

The first housing piece 10 comprises a base portion 11, a tongue portion 12 extending forwardly from the base portion 11 for inserting into the USB receptacle, and a supporting plate 13 extending backwards from the base portion 11. The first housing piece 10 also has a top wall 14, a front wall 15 and a pair of lateral walls 16 opposite to each other, the top wall 14 is connected with the front wall 15 and the pair of lateral walls 16 to form a first depression 110 and a second depression 120. The first depression 110 and the second depression 120 are facing downwards. The first depression 110 is formed on the base portion 11 and extending through the base portion 11 backwardly. The second depression 120 is formed on the tongue portion 12 to communicate with the first depression 110 along a front-to-back direction. The tongue portion 12 defines a plurality of slots 122 spaced apart from each other along a transverse direction, the slots 122 penetrate through the tongue portion 12 and communicate with the second depression 120. A plurality of ribs 123 are protruding downwards from a lower surface of the top wall 14 to be exposed in the second depression 120, every two neighboring slots 122 are separated from each other by one rib 123.

The base portion 11 defines a projection 112 extending upwards and being higher than the tongue portion 12, the base portion 11 also has a plurality of fixing passageways 114, and the projection 112 has a concave arc shape front surface 113 connected with the tongue portion 12. The fixing passageways 114 communicate with the second depression 120. A bottom surface and two lateral surface of the base portion 11 are coplanar with corresponding surface of the tongue portion 12.

The supporting plate 13 is extending backwards from the top wall 14, a bottom surface of the supporting plate 13 defines a plurality of bars 131 and a plurality of channels 132, and each channel 132 is formed by two neighboring bars.

The second housing piece 20 is of a horizontal plate structure and comprises a rear segment 21 received in the first depression 110 and a front segment 22 accommodated in the second depression 120. Three outer edges of the second housing piece 20 are fitted closely to the front wall 15 and the lateral walls 16 of the first housing piece 10 respectively, the second housing piece 20 has a bottom surface coplanar with the bottom surface of the first housing piece 10. In order to increase a combination of the first housing piece 10 with the second housing piece 20, the first housing piece 10 is fixed with the second housing piece 20 via ultrasonic welding, thus the total volume of the first housing piece 10 and the second housing piece 20 can be reduced, and the USB plug 100 can have a tiny profile. The rear segment 21 has a recess 23 on a top wall thereof for mounting the magnet 40, the USB plug 100 can attract other connectors via the attraction of the magnet 40, therefore it's convenient for consumers to carry a plug with mating connectors or multiple plugs.

The contacts 30 are arranged to be compatible with USB 2.0 standard. Each contact 30 comprises a retaining portion 31, a contacting portion 32 extending forwards from the retaining portion 31, and a tail portion 33 extending backwards from the retaining portion 31. Each retaining portion 31 comprises a horizontal portion 311 and an inclined portion 312 slantly extending downwards and forwards from the horizontal portion 311 to the contacting portion 32, and the horizontal portion 311 is connected with the tail portion 33, the horizontal portion 311 and the tail portion 33 are located on a same horizontal plane. The retaining portions 31 are mounted in the corresponding fixing passageways 114 of the first housing piece 10, the contacting portions 32 are located in the second depression 120, spaced apart from each other and limited by a neighboring rib 123 along the transverse direction. Each contacting portion 32 has an elongated convex portion 321 protruding upwards, and an elongated sunken portion 322 formed by the extrusion of the convex portion 321. The convex portions 321 are received in the corresponding slots 122, and extending upwards beyond the top wall 14 of the first housing piece 10 for mating with a USB receptacle connector. The tail portions 33 are received in the channels 132 of the supporting plate 13, and soldered with the cable 70. In an alternative embodiment, the contacts 30 can also be insert-molded in the first housing piece 10 to simplify the assembly process and reduce the production cost.

The magnet 40 is assembled or inserted-molded in the second housing piece 20, before completion of assembly, the magnet 40 has a weaker magnetic attraction, or even don't have a magnetic attraction. After the magnet 40 is fixed with the second housing piece 20, the magnet 40 is magnetized by a magnetizer to have a magnetic attraction.

The inner insulator 50 is molded on a conjunction area between the contacts 30 and the cable 70, to ensure that the contacts 30 are connected with the cable 70 stably.

The exterior insulator 60 is over-molded on the inner insulator 50, and combined with the first and second housing piece 10, 20 seamlessly. The bottom surface of the first housing piece 10 is coplanar with that of the second housing piece 20 and the exterior insulator 60.

The cable 70 is extending backwards beyond the inner insulator 50, and is enclosed by the exterior insulator 60.

A method for manufacturing the USB plug 100 includes the following steps: in the first step, the contacts 30 are assembled or insert-molded with the first housing piece 10. In the second step, the tail portions 33 of the contacts 30 are soldered to the cable 70. In the third step, the magnet 40 is assembled or formed with the second housing piece 20. In the fourth step, the second housing piece 20 is assembled upwards to the first housing piece 10, then the first housing piece 10 is combined with the second housing piece 20 without seam via ultrasonic welding. The method for manufacturing the USB plug 100 also includes a fifth step of molding the inner insulator 50, a six step of molding the exterior insulator 60. In the last step, the magnet 40 is magnetized by a magnetizer to ensure the magnet 40 with reliable magnetism.

The USB plug 100 don't have a metallic shell, the first housing piece 10 is assembled and ultrasonic welding with the second housing piece 20 to form a seamless combination, the bonding strength therebetween can be increased, the volume of the two housing pieces can be reduced, so that the USB plug 100 is provided with a tiny profile.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A universal serial bus (USB) plug, comprising:

a first housing piece having a base portion and a tongue portion extending forwards from the base portion;

a second housing piece;

a plurality of contacts, each contact comprising a contacting portion, a retaining portion fixed in the first housing piece and a tail portion, the contacting portions exposed on the tongue portion for mating with a USB receptacle connector; and a cable soldering with tail portions of the contacts; wherein the first housing piece defines a depression on a bottom surface thereof, the second housing piece is received in the depression; and wherein the first housing piece has a top wall, a front wall and a pair of lateral walls opposite to each other, the top wall is connected with the front wall and the pair of lateral walls to form the depression, the depression includes a first depression and a second depression facing downwards.

2. The USB plug as claimed in claim 1, wherein the second housing piece is of a horizontal plate structure, and is fixed to the first housing piece via ultrasonic welding.

3. The USB plug as claimed in claim 1, wherein the first depression and the second depression are communicated with each other along a front-to-back direction, the second depression is formed on the base portion.

4. The USB plug as claimed in claim 1, wherein the second housing piece comprises a rear segment received in the first depression and a front segment accommodated in the second depression.

5. The USB plug as claimed in claim 1, wherein the top wall defines a plurality of slots spaced apart from each other along a transverse direction, the contacting portions are extending upwards to insert into the corresponding slot.

6. The USB plug as claimed in claim 1, wherein the retaining portion comprises a horizontal portion and an inclined portion slantly extending downwards and forwards from the horizontal portion to the contacting portion, and the horizontal portion is connected with the tail portion, the horizontal portion and the tail portion are located on a same horizontal plane.

7. The USB plug as claimed in claim 1, wherein the first housing piece has a bottom surface coplanar with a bottom surface of the second housing piece.

8. The USB plug as claimed in claim 7, wherein each contacting portion defines an elongated convex portion protruding upwards and an elongated sunken portion formed by the extrusion of the convex portion.

9. The USB plug as claimed in claim 8, wherein the base portion defines a projection extending upwards and higher than the tongue portion, and the projection has a concave arc shape front surface connected with the tongue portion.

10. The USB plug as claimed in claim 8, wherein the contacts are insert-molded in the first housing piece.

11. The USB plug as claimed in claim 7, further comprising a magnet assembled or insert-molded with the second housing piece.

12. The USB plug as claimed in claim 7, further comprising an inner insulator and an exterior insulator, wherein the inner insulator is molded on a conjunction area between the contacts and the cable, the exterior insulator is overmolded on the inner insulator, and combined with the first and second housing piece seamlessly.

13. The USB plug as claimed in claim 12, wherein the bottom surface of the first housing piece is coplanar with that of the second housing piece and the exterior insulator, the first and second housing piece, and the inner insulator are made of plastic material, the exterior insulator is made of silicone.

* * * * *